United States Patent [19]

Backstein et al.

[11] Patent Number: 4,970,957

[45] Date of Patent: Nov. 20, 1990

[54] MINEHUNTING APPARATUS FOR REMOVING MOORED MINES

[75] Inventors: Günter Backstein, Meerbusch; Anette Brinkmann, Bochum; Steffen Weber, Meerbusch; Klaus-Jürgen Pohl, Dormagen; Eckhardt Knabel, Jülich; Hermann Schaper, Vallendar, all of Fed. Rep. of Germany

[73] Assignee: Rheinmetall GmbH, Duesseldorf, Fed. Rep. of Germany

[21] Appl. No.: 390,543

[22] Filed: Aug. 7, 1989

[30] Foreign Application Priority Data

Aug. 5, 1988 [DE] Fed. Rep. of Germany ..... 3826653

[51] Int. Cl.[5] ..... F41H 11/16

[52] U.S. Cl. ..... 102/403; 89/1.13; 114/221 A

[58] Field of Search ..... 102/402, 403; 89/1.13, 89/1.14; 114/221 A

[56] References Cited

U.S. PATENT DOCUMENTS

| | | | |
|---|---|---|---|
| 1,263,898 | 4/1918 | Johannessen et al. | 114/221 A |
| 3,755,837 | 9/1973 | Temple et al. | 441/15 |
| 3,763,512 | 10/1973 | Valihora | 441/16 |
| 3,844,244 | 10/1974 | White | 114/221 A |
| 3,850,075 | 11/1974 | Temple | 89/1.14 |
| 4,112,862 | 9/1978 | Huly et al. | 114/221 A |
| 4,606,293 | 8/1986 | Kirkland | 114/221 A |
| 4,696,234 | 9/1987 | Kaltmann et al. | 102/308 |

FOREIGN PATENT DOCUMENTS

| | | | |
|---|---|---|---|
| 338706 | 7/1921 | Fed. Rep. of Germany | 114/221 A |
| 3416027 | 10/1985 | Fed. Rep. of Germany | 102/403 |
| 145557 | 12/1920 | United Kingdom | 114/221 A |

*Primary Examiner*—Charles T. Jordan
*Assistant Examiner*—Stephen Johnson
*Attorney, Agent, or Firm*—Spencer & Frank

[57] ABSTRACT

A minehunting apparatus is carried by an underwater transporting drone to the mooring cable of a mine. The minehunting apparatus includes a housing and clamping levers pivotably mounted on the housing to close around the mooring cable. Inside the housing are explosives which are detonated by a coded sonar signal. To improve the maneuverability of the transporting drone, the weight of the minehunting apparatus is balanced so that the apparatus has an essentially neutral buoyancy during the transporting process in the water. After the clamping mechanism has clamped itself around the mooring cable, a lighterweight is released to cause the remainder of the minehunting apparatus to float upwardly toward the mine.

13 Claims, 2 Drawing Sheets

MINEHUNTING APPARATUS FOR REMOVING MOORED MINES

CROSS REFERENCE TO RELATED APPLICATION

This application claims the priority of application Ser. No. P 38 26 653.9, filed Aug. 5, 1988 in the Federal Republic of Germany, the subject matter of which is incorporated herein by reference.

BACKGROUND OF THE INVENTION

The present invention relates to a minehunting apparatus for clearing away moored mines, and more particularly to a minehunting apparatus of the type which includes a housing carrying cutting and disposal explosives, intake rails connected to the housing for guiding the mooring cable, and a clamping mechanism for clamping around the mooring cable and for causing the minehunting apparatus, once it has clamped itself around the mooring cable, to climb up the mooring cable toward the mine.

Such minehunting apparatuses per se are disclosed, for example, in U.S. Pat. No. 4,696,234. However, prior art mine-hunting apparatuses have the disadvantage that they require relatively expensive clamping mechanisms. A further disadvantage is that the transporting drone is encumbered with great static and dynamic moments during its mission due to the great weight of the minehunting apparatus, and this interferes with the maneuverability of the drone. Another drawback in the prior type of minehunting device is that activatable buoyancy means must be employed to cause the device to climb up the mooring cable. These buoyancy means require a relatively large amount of space and are expensive and easily damaged.

SUMMARY OF THE INVENTION

It is therefore an object of the present invention to improve, in particular, a minehunting apparatus which is transported by an underwater drone so that the maneuverability of the drone is influenced as little as possible by this apparatus and so that no activatable buoyancy means are required.

This and other objects which will become apparent in the ensuing detailed description can be attained by providing a minehunting apparatus, of the type which includes a housing, intake rails connected to the housing for guiding the mooring cable of a mine, and a clamping mechanism for clamping around the mooring cable and for causing the minehunting apparatus, after it has clamped itself around the cable, to climb up the cable towards the mine. This minehunting apparatus is characterized in that its weight is selected in such a manner that it is neutrally buoyant during the transporting process in the water and in that, after the clamping mechanism is clamped around the mooring cable, a lighterweight is dropped to cause the minehunting apparatus to become positively buoyant.

The present invention is thus based on the idea that the maneuverability of the transporting device, particularly the drone, is hardly interfered with if the weight of the minehunting apparatus is such that the minehunting apparatus is neutral relative to buoyancy during the transporting process. By discharging a lighterweight, the required positive buoyancy is then attained so that activatable buoyancy means can be omitted.

DESCRIPTION OF THE PREFERRED EMBODIMENT

Figure 1:
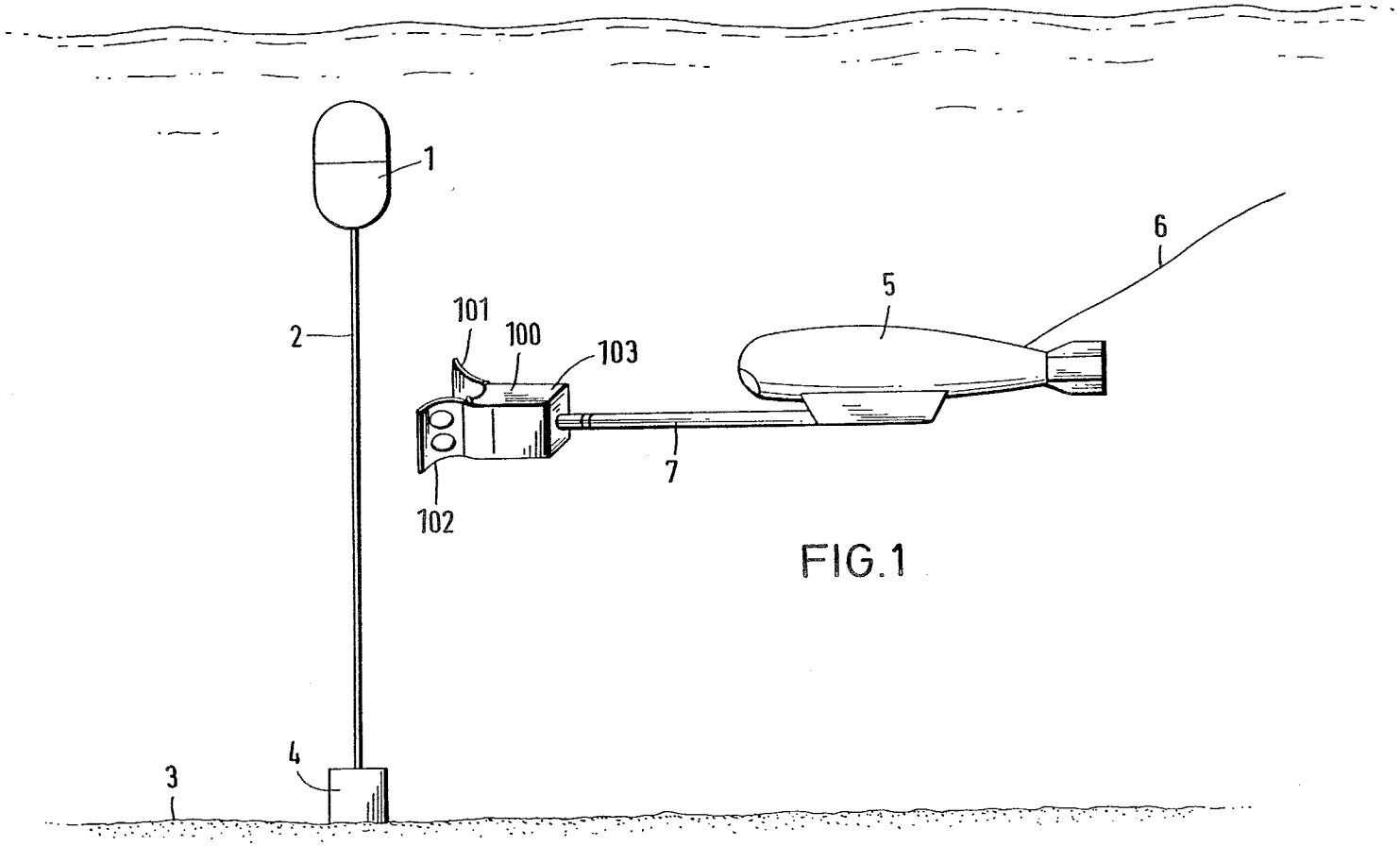
FIG. 1 is a perspective view which schematically illustrates a drone carrying a minehunting apparatus according to the invention toward the mooring cable of a mine.

FIG. 1 is a schematic illustration to explain how the minehunting apparatus 100 of the present invention is used. A moored mine 1 is connected by mooring means such as a mooring chain or a mooring cable 2 with a weight (anchor base) 4, which rests on the seabed 3. An underwater drone 5 is connected by way of a cable 6 with a minehunter ship (not shown). The minehunting apparatus is connected by a transporting rod 7 to the drone 5. Although not shown, drone 5 is remotely controlled via cable 6 by an operator on the ship. Drone 5 has a forward-directed floodlight and a television camera to generate images which are conveyed by cable 6 to the ship. Drone 5 also has a motor-driven propeller, a rudder, guide vanes, and circuitry for controlling the propeller, rudder, and guide vanes in response to command signals conveyed by cable 6 from the ship. The operator on the ship observes the television images from drone 5 and directs drone 5 toward mooring cable 2.

When drone 5 reaches mooring cable 2, the latter is pushed by intake rails 101 and 102 into a clamping mechanism (not shown in FIG. 1) of minehunting apparatus 100. As soon as mooring cable 2 is disposed in the clamping mechanism, drone 5 and transporting rod 7 are withdrawn from minehunting apparatus 100 and the lighterweight is released. The minehunting apparatus 100 floats, according to the invention, along mooring cable 2 up to mine 1 without requiring any activatable buoyancy means.

Figure 2:
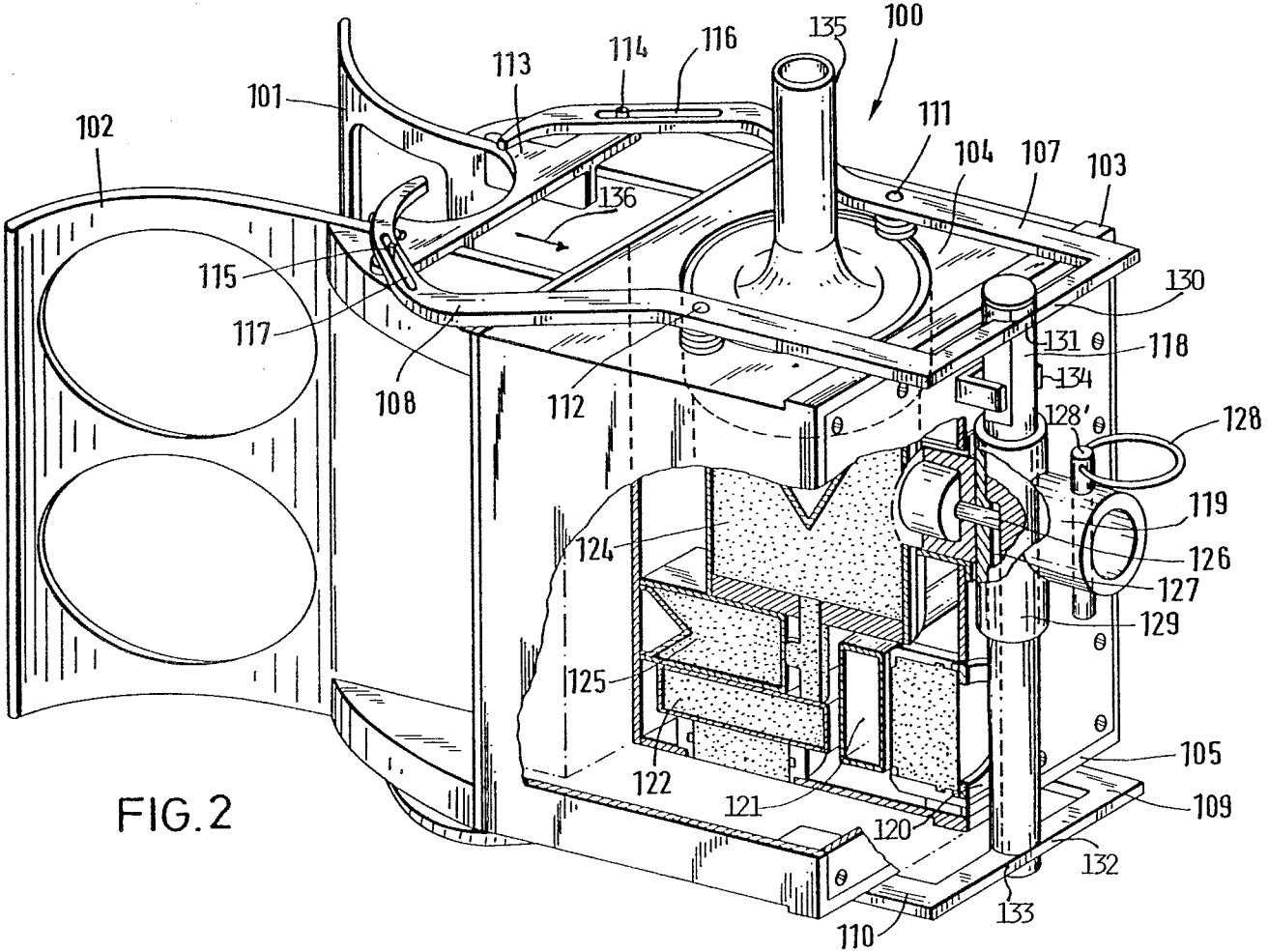
FIG. 2 is a perspective view of the minehunting apparatus according to the invention.

FIG. 2 shows the construction of the minehunting apparatus according to the invention. The intake rails are again marked 101 and 102. These intake rails are disposed at housing 103, whose upper or head portion is marked 104 while its bottom portion is marked 105. The clamping mechanism is essentially composed of clamping levers 107 and 108, which are disposed at head housing section 104, and of clamping levers 109 and 110, which are shown only in part and which are disposed at the bottom section 105 of the housing 103. The clamping levers 107 and 108 are pivotable about respective pivot posts 111 and 112 (the pivot posts for the clamping levers 109 and 110 disposed at bottom housing section 105 are not visible). Between clamping levers 107 and 108 and between levers 109 and 110 there are disposed clamping lever guides 113, which are slidably mounted on housing 103. Each clamping lever guide 113 includes pins 114 and 115, which engage guide slots 116 and 117 in the respective clamping levers.

On the side of housing 103 facing away from intake rails 101 and 102, the clamping levers 107 and 108 have respective ends 130 and 131 which extend into slots (not numbered to avoid obscuring the drawing) of a counterweight 118. The ends 132 and 133 of clamping levers 109 and 110 also extend into slots (not numbered) in counterweight 118. With the clamping levers 107–110 in the position shown in FIG. 2, it will be apparent that the ends 130–133 block lighterweight 118.

Lighterweight 118 extends through a bracket 134 affixed to housing 103. Additionally, a securing pin 126 extends into a longitudinal groove 127 in counterweight 118, thereby preventing the clamping levers 107–110 from being displaced by lighterweight 118.

At its end facing minehunting apparatus 100, transporting rod 7 (FIG. 1) is connected with minehunting apparatus 100 by way of an adapter 119, counterweight 118, and clamping levers 107 to 110. Adapter 119 and transporting rod 7 are fastened to one another by a pin 128', attached to a ring 128. Pin 128' extends through holes (not illustrated) at the end of transporting rod 7. Pin 128' is inserted when minehunting apparatus 100 is mounted on rod 7 to ensure that apparatus 100 is firmly fixed on rod 7.

Additionally, a known fuse 122 with a shaped severing charge 125 and a shaped payload charge 124 likewise disclosed in the above-mentioned U.S. Pat. No. 4,696,234 are disposed in housing 103 of minehunting device 100. Housing 103 has a hollow, upward-pointing spike 135 above shaped payload charge 124 to facilitate formation of a jet upon detonation.

Minehunting apparatus 100 as a whole, including counterweight 118, is designed to have approximately neutral buoyancy in water. As a result, apparatus 100 does not exert an appreciable torque on drone 5 during the underwater mission even though apparatus 100 is carried at the end of rod 7. Without counterweight 118, minehunting apparatus 100 is designed to be positively buoyant in water. To this end, the housing 103 is preferably made of light metal or some other light-weight material such as hard foam. The housing 103 is preferably hermetically sealed, and is filled with air or foam except for the space needed for the components therein (e.g. payload charge 124 and so forth). Furthermore the enclosures for electronic system 121, severing charge 122, and payload charge 124 are preferably made of light metal or hard foam.

The operation of the invention will now be briefly described. After sonar reconnaissance, the undersea drone 5 (FIG. 1) together with minehunting apparatus 100 is brought into the vicinity of the mooring cable 2. Minehunting apparatus 100 is moved toward cable 2, which is channeled by intake rails 101 and 102 toward clamping lever guides 113. The mooring cable 2 presses against clamping lever guides 113 and slides them in the direction of arrow 136, thus causing pins 114 and 115 to move through the obliquely outwardly oriented guide slots 116 and 117 in clamping levers 107 and 108. Consequently, at the front end of minehunting apparatus 100 the clamping levers 107 and 108 pivot toward one another and, similarly, the clamping levers 109 and 110 pivot toward one another. This traps the mooring cable, thus trapping the mooring cable 2 and attaching the minehunting apparatus 100 to it. At the rear of apparatus 100, the pivoting of clamping levers 107–110 causes ends 130–133 to move outwardly, away from the slots in lighterweight 118, so that the lighterweight 118 is released and is at most still held by pin 126.

If drone 5 now moves backwards, it retracts adapter 119 and lighterweight 118 in addition to transporting rod 7. As soon as securing pin 126 connected with minehunting apparatus 100 no longer engages in longitudinal groove 127 of lighterweight 118, the latter slides through a sleeve 129 of the adapter 119 and drops to the bottom of the sea. Dropping lighterweight 118 after minehunting apparatus 100 has been released avoids a downward force at the end of transporting rod 7, which would make drone 5 difficult or impossible to control during its return to the ship (not illustrated).

After minehunting apparatus 100 has been released from transporting rod 7, the positive buoyancy generated by the elimination of lighterweight 118 causes minehunting apparatus 100 to float upward along mooring cable 2 toward mine 1. In this connection, it is desirable for the minehunting apparatus 100 to come as closely as possible to the body of the mine 1 to realize the best possible effect for the payload charge 124 included in minehunting device 100.

During the process of releasing minehunting apparatus 100 from transporting rod 7, an electronic system 121 disposed in the minehunting device is activated. Electronic system 121 receives sonar signals from the ship (not shown) via a hydrophone 120 mounted on housing 103. After a delay time while transporting drone is withdrawn from the location of the mine 1, electronic system 121 detonates the two payloads 124 and 125 in minehunting apparatus 100 in response to acoustically coded sonar signals received from the minehunting vessel during a defined time period after the clamping process.

The payload charge 124 installed in minehunting apparatus 100 acts in the direction of the mine body and is intended to destroy it. If this is not possible because the distance between minehunting apparatus 100 and mine 1 is too great, the severing charge 125 severs the mooring cable 2 of mine 1 so that the mine 1 is able to float to the surface, where it can be destroyed by firing at it.

Preferably, before payload charge 124 and severing charge 125 are detonated, a target area illuminating device (not shown here) is released by minehunting apparatus 100 to float to the surface and illuminate the target area so that mines not destroyed by the payload charge can also be cleared at night once they have floated up to the surface.

It will be understood that the above description of the present invention is susceptible to various modifications, changes, and adaptations, and the same are intended to be comprehended within the meaning and range of equivalents of the appended claims.

What we claim is:

1. A minehunting apparatus for the removal of a mine which is connected to mooring means for the mine, the minehunting apparatus being carried toward the mooring means by an underwater transporting means, said minehunting apparatus comprising:

a housing;

intake rails connected to the housing to guide the mooring means;

clamping mechanism means mounted on the housing for clamping around the mooring means;

a lighterweight; and lighterweight holding means for temporarily mounting the lighterweight on the housing, the lighterweight holding means releasing the lighterweight after the clamping mechanism means has clamped around the mooring means, wherein the weight of the minehunting apparatus in water is selected so that the minehunting apparatus has substantially neutral buoyancy before the lighterweight is released by the lighterweight holding means, after which the housing with attached said intake rails, said clamping mechanism means, and said lighterweight holding means has a positive buoyancy and consequently floats upward along the mooring means.

2. The minehunting apparatus of claim 1, wherein the housing is made of a light metal.

3. The minehunting apparatus of claim 1, wherein the housing is made of a light-weight material.

4. The minehunting apparatus of claim 3, wherein the light-weight material is hard foam.

5. The minehunting apparatus of claim 1, further comprising a plurality of components inside the housing, at least one of the components having a container made of a light metal.

6. The minehunting apparatus of claim 1, further comprising a plurality of components inside the housing, at least one of the components having a container made of a light-weight material.

7. The minehunting apparatus of claim 6, wherein the light-weight material is hard foam.

8. The minehunting apparatus of claim 1, wherein the clamping mechanism means comprises a pair of clamping levers having forward ends;

means for pivotably mounting the pair of clamping levers to the housing so that the forward ends of the pair of clamping levers are oriented toward the intake rails;

a clamping lever guide movably mounted on the housing at a position to be displaced by engagement of the clamping lever guide with the mooring means; and means, connecting the clamping lever guide to the pair of clamping levers, for pivoting the forward ends of the pair of clamping levers around the mooring means when the clamping lever guide is displaced by the mooring means.

9. The minehunting apparatus of claim 8, wherein the pair of clamping levers additionally have rear ends, the lighterweight holding means including the rear ends of the pair of clamping levers, the rear ends of the pair of clamping levers holding the lighterweight before the forward ends of the pair of clamping levers are pivoted around the mooring mean sand being withdrawn from the lighterweight as the forward ends of the pair of clamping levers are pivoted around the mooring means.

10. The minehunting apparatus of claim 9, wherein the underwater transporting means releases the minehunting apparatus after the forward ends of the pair of clamping levers have pivoted around the mooring means, and wherein the lighter-weight holding means further includes an additional means for holding the lighterweight until after the minehunting apparatus has been released by the underwater transporting means.

11. The minehunting apparatus of claim 8, wherein the housing has a top side and a bottom side, the pair of clamping levers being disposed adjacent the top side of the housing, and wherein the clamping mechanism means further comprises another pair of clamping levers, the another pair of clamping levers being mounted adjacent the bottom side of the housing.

12. The minehunting apparatus of claim 1, wherein the underwater transporting means comprises a drone and a transporting rod attached to the drone, and wherein the minehunting apparatus further comprises means for supporting the minehunting apparatus on the transporting rod.

13. The minehunting apparatus of claim 12, wherein the means for supporting the minehunting apparatus on the transporting rod comprises an adapter having a sleeve, the lighterweight extending through the sleeve and the transporting rod being connected to the adapter.

* * * * *